US006460713B1

(12) United States Patent
Oatley et al.

(10) Patent No.: US 6,460,713 B1
(45) Date of Patent: Oct. 8, 2002

(54) ANTI-PILFER DEVICE FOR WINE BOTTLES

(75) Inventors: Andrew Geoffrey Oatley, New South Wales (AU); Colin Marshall Smith, New South Wales (AU)

(73) Assignee: Rosemount Estates Pty Ltd., New South Wales (AU)

( * ) Notice: Subject to any disclaimer, the term of this patent is extended or adjusted under 35 U.S.C. 154(b) by 0 days.

(21) Appl. No.: 09/380,275

(22) PCT Filed: Feb. 26, 1998

(86) PCT No.: PCT/AU98/00122

§ 371 (c)(1),
(2), (4) Date: Feb. 25, 2000

(87) PCT Pub. No.: WO98/38101

PCT Pub. Date: Sep. 3, 1998

(30) Foreign Application Priority Data

Feb. 28, 1997 (AT) ..... PO5380

(51) Int. Cl.[7] ..... B65D 39/02

(52) U.S. Cl. ..... 215/292; 215/230; 215/232; 40/311

(58) Field of Search ..... 215/292, 232, 215/233, 264, 364, 363, 230; 220/DIG. 21, DIG. 34, 214; 40/311

(56) References Cited

U.S. PATENT DOCUMENTS

| | | | | | |
|---|---|---|---|---|---|
| 246,649 | A | * | 9/1881 | Wilkinson | 215/364 X |
| 368,959 | A | * | 8/1887 | Morehouse | 215/364 |
| 418,549 | A | * | 12/1889 | Bridge | 215/364 |
| 472,041 | A | * | 4/1892 | Foster et al. | 215/364 |
| 505,301 | A | * | 9/1893 | Schroeder | |
| 782,411 | A | * | 2/1905 | McCoy | 215/233 |
| 802,760 | A | * | 10/1905 | Hovey | 215/364 |
| 827,665 | A | * | 7/1906 | Quick | |
| 944,030 | A | * | 12/1909 | Giffin | |
| 1,103,737 | A | * | 7/1914 | Budlong | |
| 1,116,663 | A | * | 11/1914 | Woodruff | |
| 1,340,237 | A | * | 5/1920 | Moore | 215/364 |
| 1,918,243 | A | * | 7/1933 | Berguad | 40/311 |

(List continued on next page.)

FOREIGN PATENT DOCUMENTS

| | | | | |
|---|---|---|---|---|
| AU | 24941/54 | | 4/1954 | |
| AU | 12349/61 | | 5/1963 | |
| AU | 35492/63 | | 3/1966 | |
| AU | 40307/68 | | 1/1970 | |
| CH | 104292 | * | 4/1924 | 215/364 |
| EP | 2688762 | * | 9/1993 | |
| FR | 615915 | * | 9/1994 | |
| GB | 14163 | * | 6/1896 | 215/364 |
| GB | 233412 | * | 5/1925 | 215/364 |
| JP | 4-145131 | * | 5/1992 | |
| JP | 7-16991 | * | 1/1995 | |
| JP | WO 11/26103 | * | 5/2000 | |
| WO | WO 00/55267 | * | 9/2000 | |
| WO | WO 00/55268 | * | 9/2000 | |

*Primary Examiner*—Nathan J. Newhouse
*Assistant Examiner*—Robin Hylton
(74) *Attorney, Agent, or Firm*—Fish & Richardson P.C.

(57) ABSTRACT

An anti-pilfer device for application to a cork of a wine bottle includes a disc. The disc has a recess in at least one surface and is adapted to accommodate an adhesive for securing the disc to the cork. The disc is formed from a material having a relatively wide useful temperature range. The range is from about −5° C. to about 100° C. such that the material has a glass transition temperature below about −5° C. and a softening point in excess of about 100° C.

22 Claims, 2 Drawing Sheets

U.S. PATENT DOCUMENTS 2,091,350 A * 8/1937 Bomeisler ..... 215/364
2,192,511 A * 3/1940 Thomas ..... 215/364
2,338,102 A * 1/1944 Fields ..... 604/415
3,109,575 A * 11/1963 Aldington ..... 215/292 X
3,352,762 A * 11/1967 Weiner ..... 215/364 X
3,559,834 A * 2/1971 Taylor ..... 426/118 X
3,628,681 A * 12/1971 Schwartz ..... 215/364
3,934,746 A * 1/1976 Lilja ..... 215/364 X
4,553,679 A * 11/1985 Hatakeyama et al. ..... 215/232
4,767,016 A * 8/1988 Cook, Jr. et al. ..... 215/232 X
5,081,174 A * 1/1992 VanBuskirk
5,261,547 A * 11/1993 Finke ..... 215/233
5,447,246 A * 9/1995 Finke ..... 215/233
5,449,080 A * 9/1995 Finke ..... 215/364 X
5,553,728 A * 9/1996 Finke ..... 215/364 X
5,562,226 A * 10/1996 Valyi et al. ..... 215/232 X
5,658,625 A * 8/1997 Bradfute et al. ..... 428/34.9
5,668,251 A * 9/1997 Malik et al.
5,778,635 A * 7/1998 Galandrino ..... 53/306

* cited by examiner

ANTI-PILFER DEVICE FOR WINE BOTTLES

FIELD OF THE INVENTION

There is a trend away from the old style capsule seal on the top of a wine bottle to a security cap or anti-pilfer seal. The cap can be of a paper type and mere are variations through to a wax cap which approaches an old method of using scaling wax. Present bottle filling rates appear to demand that any sealing device is premade and only attachment takes place on the production line.

Known wax caps from the United States are made of "wax" and are adhered to the top of the cork using hot-melt glue. The top of the cork is pushed a small distance into the neck of the bottle so that the wax cap when attached is approximately flush with the top of the bottle.

"Wax" has some inherent problems when used for this purpose. It is a convenient material and is relatively easy to handle but it has a limited range of useful temperatures. When cooled below the glass transition temperature it becomes very brittle and susceptible to shattering when subject to the entry of a cork screw. The temperature range between glass transition temperature and the softening point is limited to about 40° C. while the melting point is below 100° C. The "wax" currently being used appears to have a glass transition temperature close to the temperature of a domestic refrigerator, which means that some caps shatter when the cork is extracted. The softening temperature appears to be less than that reached inside a car when in direct sunlight, which again is a problem.

Further to the above, the known wax caps take the form of a basic disc having flat upper and lower surfaces. A flat lower surface in particular leaves little room for the application of hot melt adhesive between the cap and the top of the cork. As a result, the adhesive can leak from the side of the cap during application and leave little adhesive in position to secure the cap to the cork and at the same time deposit a mess of adhesive on the lip of the bottle.

OBJECT OF THE INVENTION

It is the object of the present invention to overcome or substantially ameliorate at least one of the above disadvantages and/or more generally to provide an improved anti-pilfer cap.

DISCLOSURE OF THE INVENTION

There is disclosed herein an anti-pilfer device for application to a cork of a wine bottle, the device having a disc formed from a material having a relatively wide useful temperature range as defined herein, the disc being provided with a recess in at least one surface thereof, which recess is adapted to accommodate adhesive.

Preferably, the disc is formed of plastics material.

Preferably, the recess is cylindrical.

Alternatively, the recess can be in the form of a concavity.

Preferably. the cap has an annular rib about the recess or recesses.

Preferably, the device is engineered to have a low penetration strength so that it is easy to insert a cork screw therethrough for removal of the cork from the bottle.

Preferably, the cap is formed of polymer wax.

There is further disclosed herein a combination including a bottle having a neck, a cork received wholly within the neck and the and-pilfer device as disclosed above, wherein adhesive is located in the recess and serves to secure the disc of the anti-pilfer device to the cork.

Preferably, the anti-pilfer device is positioned wholly within the rack.

DEFINITION

As used herein the term "relatively wide useful temperature range" is intended to mean that the glass transition temperature is below −5° C. while the softening point is not reached until in excess of 100° C. The melting point is well above this.

BRIEF DESCRIPTION OF THE DRAWINGS

A preferred form of the present invention will now be described by way of example with reference to the accompanying drawings, wherein.

DESCRIPTION OF THE PREFERRED EMBODIMENT

Figure 1:
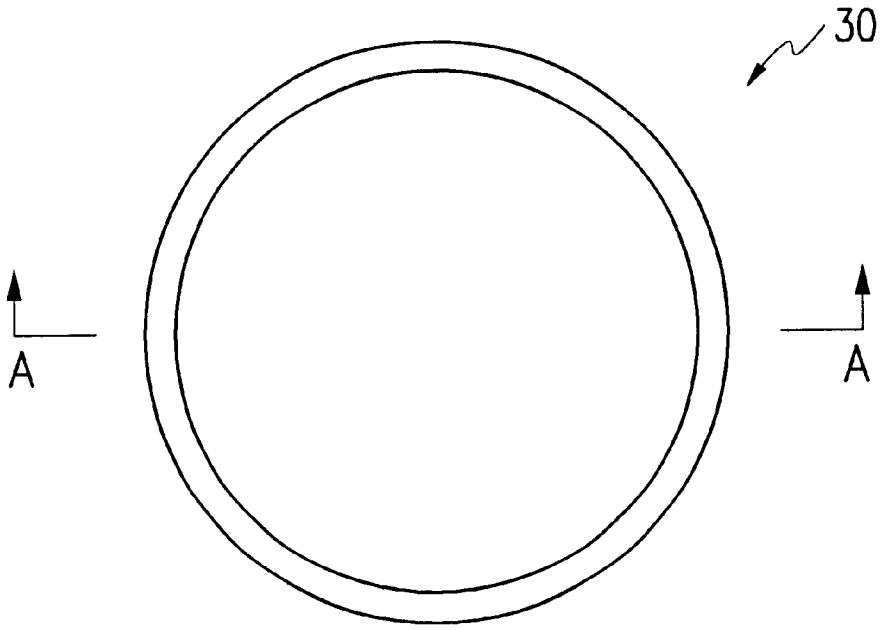
FIG. 1 is a schematic plan view of an and-pilfer device.
Figure 2:
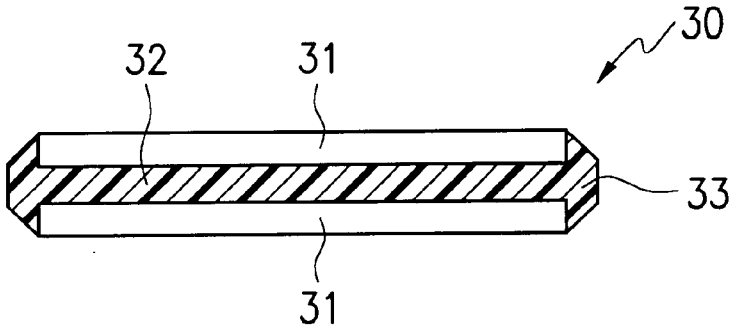
FIG. 2 is a schematic cross-sectional view of the device of FIG. 1 taken at A—A.

In FIGS. 1 and 2 of the accompanying drawings there is schematically depicted an anti-pilfer device 30. Device 30 is typically fabricated from "polymer wax" and is engineered to have a low penetration strength so that it is easy to insert a cork screw therethrough. The device 30 has an upper and lower recess 31 into one of which adhesive can be applied for connecting the device to the upper surface of a cork. About the periphery of the cap 30 there is an annular rib 33 which defines the shape of each of recess 31. The recesses 31 are separated by a thin web 32, to the upper and lower surfaces of which there can be impressed, adhered or otherwise imprinted a logo for example. The web 32 should be sufficiently thin for easy penetration a corkscrew or other conventional removing device. The web 32 in the embodiment of FIGS. 1 and 2 includes upper and lower surfaces which are substantially flat. That is, the recesses 31 are substantially cylindrical.

Figure 3:
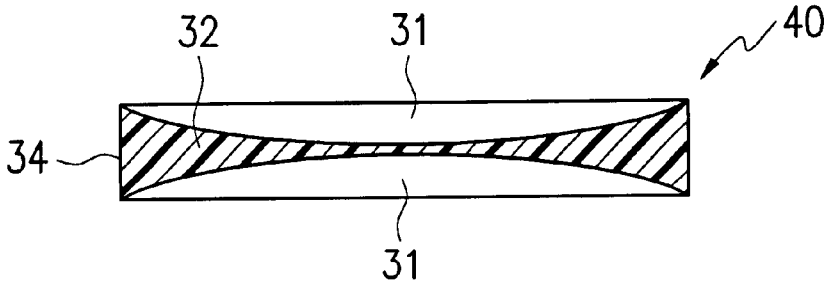
FIG. 3 is a schematic cross-sectional view of another device.

As an alternative, and as shown in FIG. 3, the recesses 31 might be in the form of a concavity That is, the upper and lower surfaces of the web 32 can be curved like the inside surface of a sphere.

Figure 4:
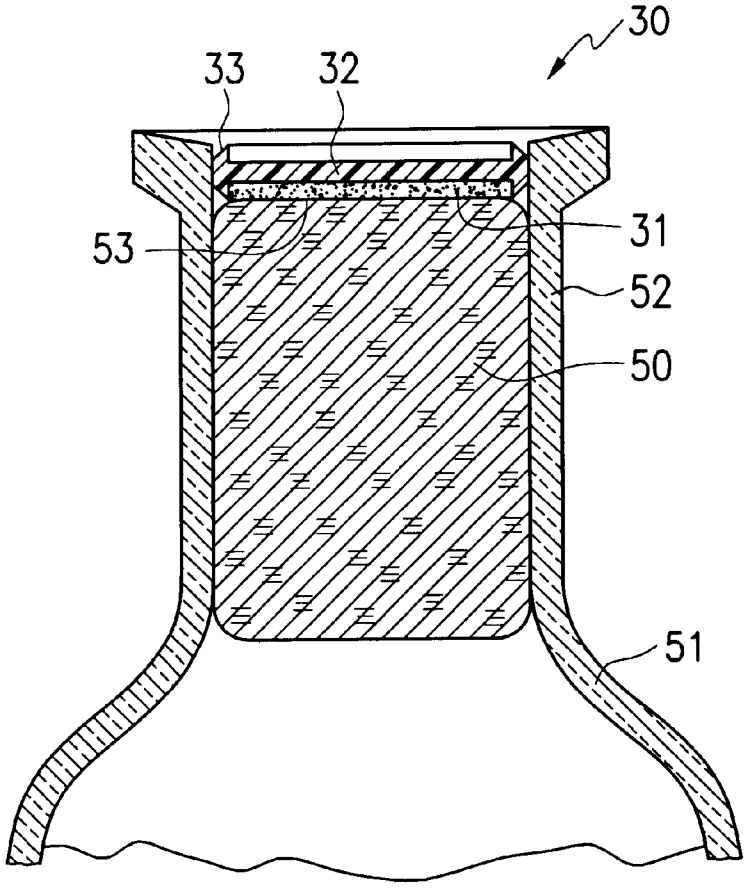
FIG. 4 is a schematic cross-sectional elevational view of the anti-pilfer device of FIGS. 1 and 2 in position upon a cork within the neck of a wine bottle.

As shown in FIG. 4, the disc 30 of FIGS. 1 and 2 is shown in place within the neck 52 of a wine bottle 51. A cork 50 is positioned within the neck 52. Adhesive 53 is positioned in the recess 31 at the underside of web 32. It should be noted that an annular ridge 33 extends around the web 32 and serves to prevent lateral spillage of the adhesive 53 from the space between the web 32 and the upper surface of cork 50. In the embodiment of FIG. 3, the annular ridge 33 is not provided. Instead, the cylindrical surface of each concavity 31 extends to the outer edge 34 of the disc 40, serving the same purpose.

It should be appreciated that modifications and alterations obvious to those skilled in the art are not to be considered as beyond the scope of the present invention. For example, a recess 31 might be provided only at one side of the device.

By way of the present invention, it will be clear to the observer that pilfering of the wine bottle has not occurred by the fact that the web 32 is free of penetration marks or fractures. Since there is very little if any space between the outer periphery of the disc 30 or 40 and the inner surface of the wine bottle neck, it is not feasible that implements be inserted for the purpose of lifting the disc without damaging the disc. Also, it should be apparent to the addressee that a significant advantage of the present invention is that the adhesive 53 is retained between the web 32 and the upper surface of cork 50 without later a spillage, a problem associated with the prior art and as mentioned earlier.

What is claimed is:

1. A combination comprising:

a bottle having a neck having an inner diameter;

a cork received wholly within the neck, the cork having an upper surface and a consistent outer diameter along its length, and being configured to mate with the inner diameter of the neck; and an anti-pilfer device comprising a disc having an outer diameter that is approximately the same as the outer diameter of the cork, including a recess in at least one surface of the disc, the recess facing the upper surface of the cork and including an adhesive within the recess and in contact with the cork, and being formed from a material having a relatively wide useful temperature range, said range being from about −5° C. to about 100° C. so that said material has a glass transition temperature below about −5° C. and a softening point in excess of about 100° C.

2. The combination of claim 1, wherein the anti-pilfer device is positioned wholly within the neck.

3. The combination of claim 1, wherein the disc is formed of plastics material.

4. The combination of claim 1, wherein the recess is cylindrical.

5. The combination of claim 1, wherein the recess is in the form of a concavity.

6. The combination of claim 1, wherein the disc has an annular ridge about the recess or recesses.

7. The combination of claim 1, wherein the disc has a penetration strength low enough to permit penetration of the disc by a cork screw.

8. The combination of claim 1, wherein the disc comprises a first recess and a second recess.

9. The combination of claim 8, wherein the adhesive is located in the first recess or the second recess.

10. A method of applying an anti-pilfer device to a cork of a wine bottle, the method comprising:

providing a wine bottle having a neck having an inner diameter;

providing a cork, the cork having an upper surface and a consistent outer diameter along its length, and being configured to mate with the inner diameter of the neck;

providing an anti-pilfer device comprising a disc including a recess in at least one surface of the disc and being formed from a material having a relatively wide temperature range, said range being from about −5° C. to about 100° C. so that said material has a glass transition temperature below about −5° C. and a softening point in excess of about 100° C. wherein the recess is adapted to accommodate an adhesive for securing the disc to the cork;

inserting the cork wholly into the neck of the wine bottle;

applying an adhesive to the recess; and securing the anti-pilfer device to the cork, wherein the adhesive in the recess is in contact with the upper surface of the cork.

11. The method of claim 10, wherein the disc is formed of plastics material.

12. The method of claim 10, wherein the recess is cylindrical.

13. The method of claim 10, wherein the recess is in the form of a concavity.

14. The method of claim 10, wherein the disc has an annular ridge about the recess or recesses.

15. The method of claim 10, wherein the disc has a penetration strength low enough to permit penetration of the disc by a cork screw.

16. A method of visually detecting whether the contents of a bottle having a cork have been tampered with or pilfered, the method comprising:

providing a combination of:

a bottle having a neck having an inner diameter;

a cork received wholly within the neck, the cork having an outer diameter configured to mate with the inner diameter of the neck and an upper surface; and an anti-pilfer device comprising a disc having an outer diameter that is approximately the same as the outer diameter of the cork, including a recess in at least one surface of the disc, the recess facing the upper surface of the cork and including an adhesive within the recess and in contact with the cork, and being formed from a material having a relatively wide useful temperature range, said range being from about −5° C. to about 100° C. so that said material has a glass transition temperature below about −5° C. and a softening point in excess of about 100° C.; and visually inspecting the anti-pilfer device to determine whether it is free of fractures or penetration marks indicative of the contents of the bottle being tampered with or pilfered.

17. The method of claim 16 wherein the disc is formed of a plastics material.

18. The method of claim 16 wherein the recess is cylindrical.

19. The method of claim 16 wherein the recess is in the form of a concavity.

20. The method of claim 16 wherein the disc has an annular ridge about the recess or recesses.

21. The method of claim 16, wherein the disc has a penetration strength low enough to permit penetration of the disc by a cork screw.

22. The method of claim 16 wherein the disc is formed of polymer wax.

* * * * *